US009995169B2

(12) United States Patent
Schaeffer et al.

(10) Patent No.: US 9,995,169 B2
(45) Date of Patent: Jun. 12, 2018

(54) CALCIUM-MAGNESIUM-ALUMINOSILICATE RESISTANT COATING AND PROCESS OF FORMING A CALCIUM-MAGNESIUM-ALUMINOSILICATE RESISTANT COATING

(71) Applicant: GENERAL ELECTRIC COMPANY, Schenectady, NY (US)

(72) Inventors: Jon Conrad Schaeffer, Simpsonville, SC (US); Surinder Singh Pabla, Greer, SC (US); Paul Stephen Dimascio, Greer, SC (US); Krishnamurthy Anand, Karnataka (IN); Joshua Lee Margolies, Niskayuna, NY (US); Padmaja Parakala, Karnataka (IN)

(73) Assignee: General Electric Company, Schenectady, NY (US)

( * ) Notice: Subject to any disclaimer, the term of this patent is extended or adjusted under 35 U.S.C. 154(b) by 304 days.

(21) Appl. No.: 13/801,547

(22) Filed: Mar. 13, 2013

(65) Prior Publication Data

US 2014/0272467 A1 Sep. 18, 2014

(51) Int. Cl.
*B05D 7/00* (2006.01)
*F01D 25/08* (2006.01)
(Continued)

(52) U.S. Cl.
CPC ..... *F01D 25/08* (2013.01); *C23C 28/042* (2013.01); *F01D 25/005* (2013.01); *F01D 5/288* (2013.01)

(58) Field of Classification Search
CPC ..... F01D 25/08; C23C 28/042
See application file for complete search history.

(56) References Cited

U.S. PATENT DOCUMENTS 5,683,825 A * 11/1997 Bruce et al. ..... 428/698
5,685,917 A * 11/1997 Sangeeta ..... 134/2
(Continued)

FOREIGN PATENT DOCUMENTS

EP 1683773 A2 7/2006
JP H10502133 A 2/1998
(Continued)

OTHER PUBLICATIONS

Levi, Environmental degradation of thermal-barrier coatings by molten deposits, MRS Bulletin, vol. 37, Oct. 2012, p. 932-941.*
(Continued)

*Primary Examiner* — Tabatha Penny
(74) *Attorney, Agent, or Firm* — McNees Wallace & Nurick LLC

(57) ABSTRACT

A process of forming a calcium-magnesium-aluminosilicate (CMAS) penetration resistant coating, and a CMAS penetration resistant coating are disclosed. The process includes providing a thermal barrier coating having a dopant, and exposing the thermal barrier coating to calcium-magnesium-aluminosilicate and gas turbine operating conditions. The exposing forming a calcium-magnesium-aluminosilicate penetration resistant layer. The coating includes a thermal barrier coating composition comprising a dopant selected from the group consisting of rare earth elements, non-rare earth element solutes, and combinations thereof. Additional or alternatively, the coating includes a thermal barrier coating and an impermeable barrier layer or a washable sacrificial layer positioned on an outer surface of the thermal barrier coating.

19 Claims, 3 Drawing Sheets

(51) Int. Cl.

| | |
|---|---|
| ***F01D 25/00*** | (2006.01) |
| ***C23C 28/04*** | (2006.01) |
| *F01D 5/28* | (2006.01) |

(56) References Cited

U.S. PATENT DOCUMENTS

| | | | | |
|---|---|---|---|---|
| 5,773,141 | A * | 6/1998 | Hasz et al. | 428/335 |
| 6,858,334 | B1 * | 2/2005 | Gorman | C04B 35/486 416/241 B |
| 2007/0160859 | A1 * | 7/2007 | Darolia et al. | 428/469 |
| 2009/0184280 | A1 | 7/2009 | Lee | |

FOREIGN PATENT DOCUMENTS

| | | | |
|---|---|---|---|
| JP | H10502310 | A | 3/1998 |
| WO | 2012012431 | A1 | 1/2012 |

OTHER PUBLICATIONS

Almasi, Selecting Your Next combustion Turbine, WorleyParsons Services Pty Ltd., Jun. 1, 2011, p. 1-20.*

Huang, Experimental study of the thermal conductivity of metal oxides co-doped yttria stabilized zirconia, Materials Science and Engineering B, 149 (2008), p. 63-72.*

European Search Report dated Jan. 23, 2017.

JP Notice of Preliminary Rejection, dated Mar. 21, 2018, 2 pages.

* cited by examiner

CALCIUM-MAGNESIUM-ALUMINOSILICATE RESISTANT COATING AND PROCESS OF FORMING A CALCIUM-MAGNESIUM-ALUMINOSILICATE RESISTANT COATING

FIELD OF THE INVENTION

The present invention is directed to thermal barrier coatings and methods of forming thermal barrier coatings. More specifically, the present invention is directed to calcium-magnesium-aluminosilicate (CMAS) resistant thermal barrier coatings and methods of forming CMAS resistant thermal barrier coatings.

BACKGROUND OF THE INVENTION

Gas turbines are continuously exposed to increasing operating temperatures in order to enhance efficiency and performance. In order to withstand the increasing temperatures, components of the gas turbines are coated with thermal barrier coatings (TBC). The TBCs provide low thermal conductivity and ultra low thermal conductivity coatings for the gas turbine components.

During operation of the gas turbine, the TBCs can become damaged and/or degraded. The damage and/or degradation of the TBC may expose the gas turbine component to temperatures which damage the component. Often, the damage and/or degradation of the TBC are due to the atmospheric and operational conditions of the gas turbine.

For example, at the high operating temperatures of the gas turbine, environmentally ingested contaminants, such as airborne sand/ash particles, melt on the hot TBC surfaces and form calcium-magnesium-aluminosilicate (CMAS) glass deposits. The CMAS glass penetrates the TBC and leads to loss of strain tolerance and TBC failure.

A thermal barrier coating and method of forming a thermal barrier coating not suffering from the above drawbacks would be desirable in the art.

BRIEF DESCRIPTION OF THE INVENTION

In an exemplary embodiment, a process of forming a calcium-magnesium-aluminosilicate penetration resistant coating includes providing a thermal barrier coating having a dopant, and exposing the thermal barrier coating to calcium-magnesium-aluminosilicate and gas turbine operating conditions. The exposing forms a calcium-magnesium-aluminosilicate penetration resistant layer.

In another exemplary embodiment, a calcium-magnesium-aluminosilicate penetration resistant thermal barrier coating includes a thermal barrier coating composition comprising a dopant. The dopant is selected from the group consisting of rare earth elements, non-rare earth element solutes, and combinations thereof.

In another exemplary embodiment, a calcium-magnesium-aluminosilicate penetration resistant thermal barrier coating includes a thermal barrier coating and an impermeable barrier layer or a washable sacrificial layer positioned on an outer surface of the thermal barrier coating.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary calcium-magnesium-aluminosilicate (CMAS) resistant coating and a process of forming a calcium-magnesium-aluminosilicate (CMAS) resistant coating. Embodiments of the present disclosure, in comparison to processes not utilizing one or more features disclosed herein, lower thermal conductivity, increase resistance to CMAS, shift crystallization rate and/or crystallization temperature, form washable CMAS penetration resistant sacrificial layers, increase diopside formation, increase melting point, reduce wetting of surfaces, increase CMAS viscosity, or a combination thereof.

Figure 1:
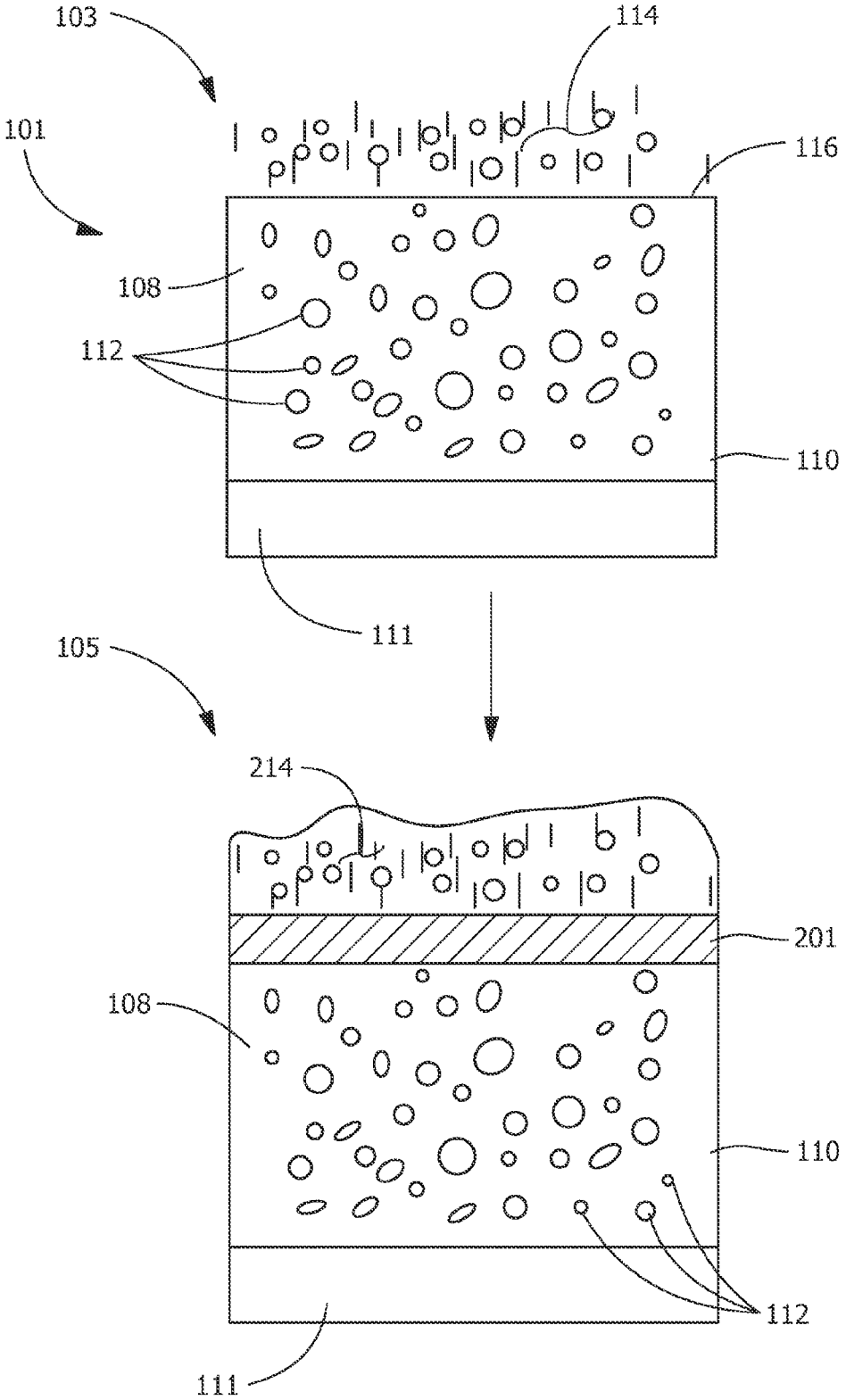
FIG. 1 is a schematic view of a process of forming a thermal barrier coating according to the disclosure.

FIG. 1 shows a process 101 of forming a CMAS penetration resistant layer 201. In one embodiment, the CMAS penetration resistant layer 201 is resistant to environmental contaminants in addition to CMAS. Environmental contaminants include, but are not limited to, sand, dirt, ash cement, dust, oxidation products, impurities from fuel sources, impurities from air sources, or a combination thereof. In one embodiment, a thermal barrier coating (TBC) 110 is provided on a substrate 111; the TBC 110 includes a dopant 112 and any suitable TBC composition 108.

Suitable TBC compositions 108 include, but are not limited to, compositions having low thermal conductivity (low K), compositions having ultra low thermal conductivity (ultra low K), and compositions having thermal conductivity between low K and ultra low K, as effected or not effected by inclusion of the dopant 112. As used herein, "low K" refers to having a thermal conductivity that is at least about 30% less than the thermal conductivity of 7YSZ. As used herein, "ultra low K" refers to having a thermal conductivity that is at least about 50% less than the thermal conductivity of 7YSZ. A 30% decrease in the thermal conductivity produces a 0.1% increase in efficiency for a combined cycle, while a 50% decrease in the thermal conductivity produces a 0.2% increase in efficiency for a combined cycle. In one embodiment, the TBC composition 108 includes YSZ, for example, having a coefficient of thermal expansion (CTE) of about $10.5\times10^{-6}/°$ C. In one embodiment, the TBC composition 108 includes $Al_2O_3$, for example, having a. CTE of about $7\times10^{-6}/°$ C. In one embodiment, the TBC composition 108 includes MgO, for example, having a CTE of about $12.8\times10^{-6}/°$ C. In one embodiment, the TBC composition 108 includes MgO and $Al_2O_3$, for example, having a CTE that is closer to that of YSZ. A lowering of the thermal conductivity of the TBC 110 increases efficiency of a system and increases an expected life of the substrate 111.

According to the process 101, the doped TBC 110 is exposed to CMAS 114 (step 103) and operational temperatures or other conditions, for example, of a turbine system (not shown), such as, a power generation system or a turbine engine. Suitable operational temperatures and/or material surface temperatures include, but are not limited to, at least about 1100° C., at least about 1200° C., at least about 1300° C., at least about 1400° C., at least about 1600° C., between about 1100° C. and about 1600° C., between about 1200° C. and about 1600° C., between about 1300° C. and about 1400° C., between about 1400° C. and about 1600° C., between about 1100° C. and about 1400° C., between about 1200° C. and about 1400° C., or any suitable combination, sub-combination, range, or sub-range thereof. Suitable operational durations include, but are not limited to, about 1,000 hours, about 5,000 hours, about 10,000 hours, about 15,000 hours, about 20,000 hours, about 25,000 hours, or any suitable combination, sub-combination, range, or sub-range therein.

The dopant 112 in the doped TBC 110 forms the CMAS penetration resistant layer 201 (step 105) when exposed to the CMAS 114 and the operational temperatures. In one embodiment, the CMAS penetration resistant layer 201 is a dense sealant reaction layer, such as an impermeable barrier layer, formed between a CMAS melt 214 and the thermal barrier coating 110. The impermeable barrier layer arrests ingression of the CMAS 114 into the TBC 110. In one embodiment, the impermeable barrier layer includes, but is not limited to, oxides such as $SiO_xN_y$ (having a melting point greater than 1420° C.), $HfO_2$, $Ta_2O_5$, $TiO_2$, and combinations thereof. In one embodiment, the impermeable barrier layer includes, but is not limited to, non-oxides such as carbides, nitrides, silicides and combinations thereof.

Figure 2:
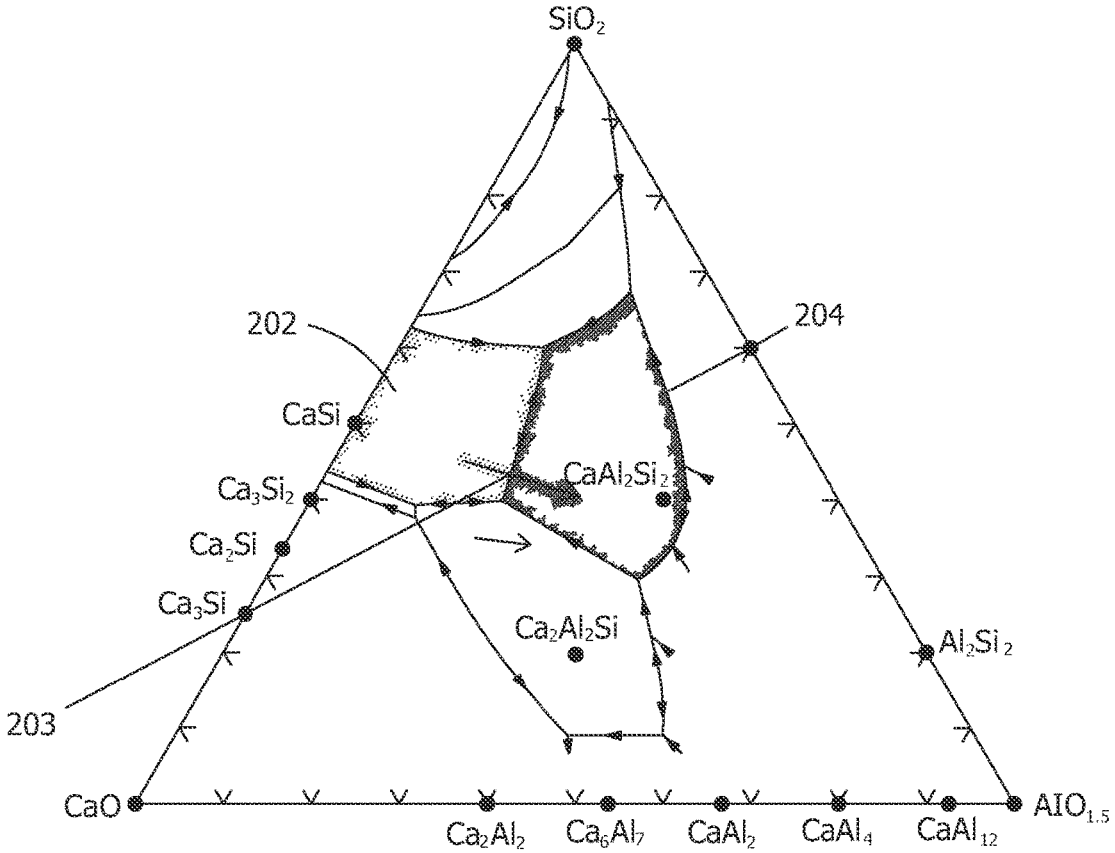
FIG. 2 shows shifting of a difficult to crystallize composition to a rapid crystallization composition according to an embodiment of the disclosure.

As represented by FIG. 2, in one embodiment, the dopant 112 forms the CMAS penetration resistant layer 201 by shifting (step 203) a difficult to crystallize composition 202 (such as, pseudo-wollastonite glass composition) to a rapid crystallization composition 204 (such as, apatite). As used herein, the term "shifting" and grammatical variations thereof refer to an interaction that results in a predetermined crystallization of a particular phase. For example, the shifting (step 203) according to the disclosure is capable of increasing or decreasing likelihood of the CMAS 114 crystallizing as wollastonite, pseudo-wollastinite, melilite, pyroxene, forsterite, tridymite, cristobalite, periclase, rankinite, lime, spinel, anorthite, cordierite, mullite, merwinite, or a combination thereof. Additionally or alternatively, the shifting (step 203) according to the disclosure is capable of increasing or decreasing a liquidus temperature of the CMAS 114, for example, at least about 1100° C., at least about 1200° C., at least about 1300° C., at least about 1400° C., between about 1100° C. and about 1400° C., between about 1200° C. and about 1400° C., between about 1300° C. and about 1400° C., and/or an amount above or below the operational temperature. In one embodiment, MgO facilitates the shifting 203 through formation of diopside [$Ca(Mg,Al)(Si,Al)_2O_6$]. In one embodiment, an increased concentration of Mg facilitates the shifting 203 through formation of $MgAl_2O_4$ spinel. In one embodiment, the dissolution of $\alpha$-$Al_2O_3$ facilitates the shifting 203 through formation of anorthite platelets ($CaAl_2Si_2O_8$).

The dopant 112 is any suitable rare earth material capable of the shifting (step 203), for example, the dopant 112 in the TBC 110 being selected from the group consisting of, but not limited to, rare earth elements such as Ti, Al, La, Yb, Sm, and suitable combinations thereof. In a suitable embodiment, the dopant 112 has a thermal conductivity of approximately 1 W/mk, between approximately 0.1 W/mk and approximately 1 W/mk, between approximately 0.5 W/mk and approximately 1 W/mk, between approximately 0.5 W/mk and approximately 0.75 W/mk, between approximately 0.75 W/mk and approximately 1 W/mk, or any suitable combination, sub-combination, range, or sub-range thereof. In one embodiment, the dopant 112 in the TBC 110 is any suitable solute for incorporation in the TBC 110 formation, such as, but not limited to, $InFeZnO_4$, mischmetal oxides, zirconia ($ZrO_2$) doped with oxides (such as $Yb_2O_3$, $La_2O_3$, $Sm_2O_3$, $TiO_2$, and $Al_2O_3$), and suitable combinations thereof.

The dopant 112 concentration controls the rate of the formation (step 105) of the CMAS penetration resistant layer 201. For example, in one embodiment, the dopant 112 concentration is, by weight, between about 30% and about 60%, between about 50% and about 80%, between about 60% and about 85%, between about 45% and about 65%, between about 50% and about 60%, between about 45% and about 55%, between about 55% and about 65%, or any suitable combination or sub-combination thereof. An increase in the concentration of the dopant 112 increases the CMAS penetration resistant layer 201 formation, regardless of the dopants 112 composition.

In one embodiment, the TBC 110 includes multiple layers. One or more of the multiple layers includes the dopant 112. In one embodiment, the dopant 112 has the same composition and/or concentration for at least two of the multiple layers. In one embodiment, the dopant 112 has a different composition and/or concentration for at least two of the multiple layers.

During the process 101, in one embodiment, an outer face 116 of a layer most distal from the substrate 111 is exposed (step 103) to the CMAS 114. The formation (step 105) of the CMAS penetration resistant layer 201 is on the outer face 116. The formation (step 105) of the CMAS penetration resistant layer 201 prevents one or more layers between the outer face 116 and the substrate 111 from being exposed to the CMAS 114.

As shown in FIG. 1, in one embodiment, the CMAS 114 forms the CMAS melt 214 over the CMAS penetration resistant layer 201. The CMAS melt 214 is incapable of penetrating the CMAS penetration resistant layer 201, and as such, the CMAS penetration resistant layer 201 prevents ingression of the CMAS 114 into the TBC 110.

Figure 3:
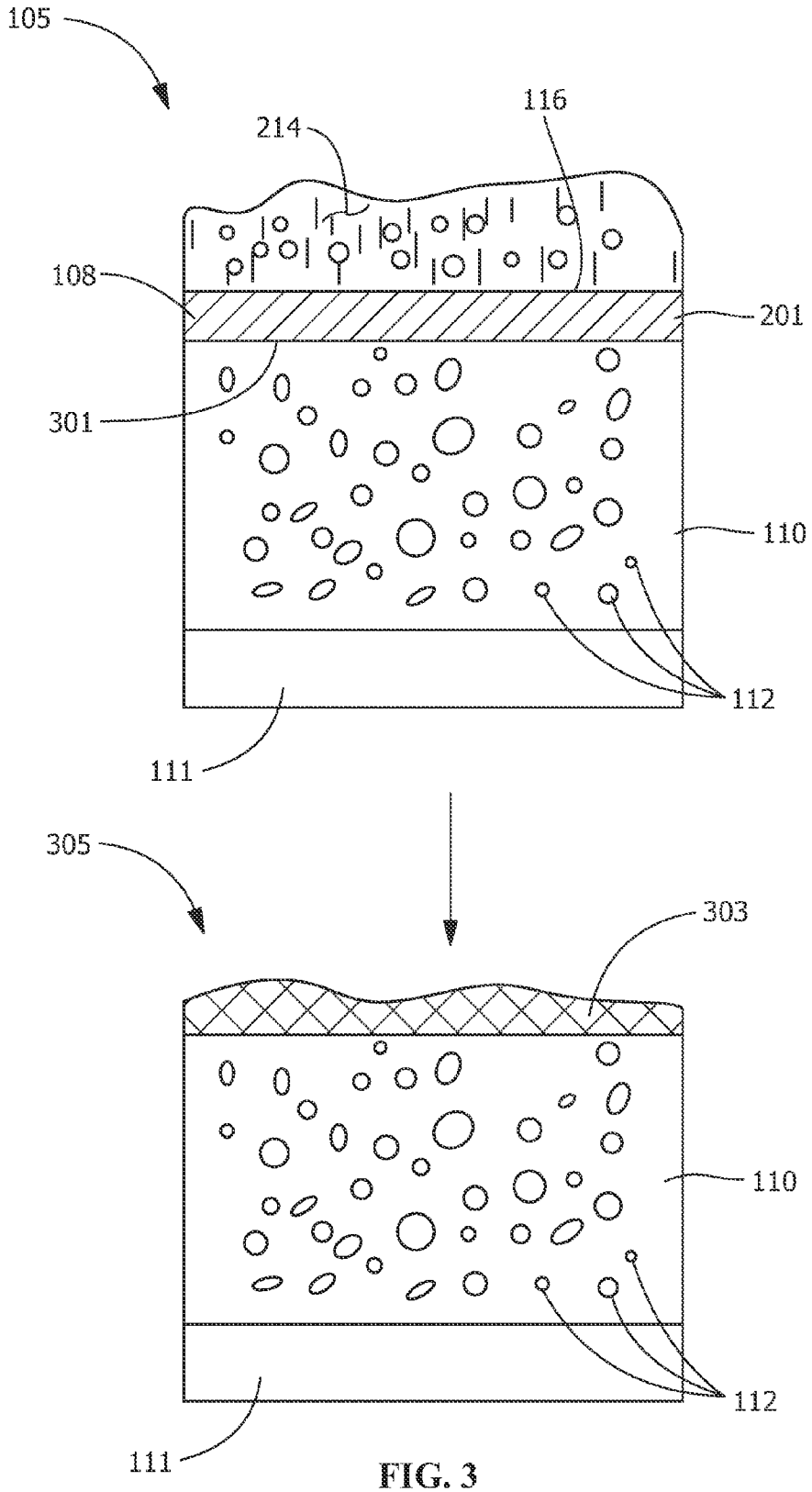
FIG. 3 is a schematic view of a process of forming a thermal barrier coating according to the disclosure.

Referring to FIG. 3, in one embodiment, material is sacrificed (step 305). For example, in one embodiment, the outer face 116 and the CMAS penetration resistant layer 201 are removed to expose an underlayer 301 to the CMAS 114. The dopant 112 in the underlayer 301 forms an additional layer serving as a post-sacrificial CMAS penetration resistant layer 303. Additionally or alternatively, in one embodiment, a washable sacrificial layer (not shown) is applied over the outer face 116 of the TBC 110, whether the TBC 110 includes the dopant 112 or is devoid of the dopant 112. The washable sacrificial layer is formed by infiltration of suitable materials in the outer face 116. In one embodiment, the suitable materials include, but are not limited to, MgO, magnesia, chromia, calcia, and combinations thereof. An $MgSO_4$ formation enables ash deposits to be removed from the outer face 116 during a water washing step. For example, in one embodiment, $MgSO_4$ is formed by the following reaction:

$$V_2O_5+3MgO \rightarrow Mg_3(VO_4)_2\ Mg_3(VO_4)_2+SO_3 \rightarrow Mg_2V_2O_7+MgSO_4$$

As will be appreciated by those skilled in the art, in general, the process 101 is dependent upon the composition of the CMAS 114. In one embodiment, the composition of the CMAS 114 is controlled, predicted, monitored, or a combination thereof. Depending upon the composition of the CMAS 114, the TBC 110, the dopant 112, or other materials used in the process 101, the melting point of the CMAS 114 is capable of being increased or decreased, the crystallization rate of the CMAS 114 is capable of being increased or decreased (for example, by increasing or decreasing the crystallization temperature), the wettability of the CMAS 114 is capable of being increased or decreased, or a combination thereof.

Suitable compositions for the CMAS 114 include, but are not limited to, environmental contaminant compositions including oxides, such as, Ca, Mg, Al, Si, Fe, Ni, Ti, Cr, and combinations thereof. In specific embodiments, the composition of the CMAS 114 is selected from those shown below in Table 1 and combinations, sub-combinations, ranges, and sub-ranges based upon those shown below:

TABLE 1

| Liquidus Temp C. | Liquidus Temp F. | CaO mol % | MgO mol % | A1203 mol % | SiO2 mol % |
|---|---|---|---|---|---|
| 1239 | 2262 | 33.3 | 8.4 | 8.3 | 50 |
| 1263 | 2305 | 32.8 | 8.4 | 8.7 | 50 |
| 1270 | 2318 | 25.7 | 16 | 8.9 | 49.4 |
| 1258 | 2296 | 34.2 | 7 | 8.8 | 50 |
| 1288 | 2350 | 37.1 | 2.9 | 10.1 | 50 |
| 1323 | 2413 | 25 | 14.1 | 10.9 | 50 |
| 1333 | 2431 | 27.6 | 11.3 | 11 | 50 |
| 1328 | 2422 | 35.8 | 2.9 | 11.3 | 50 |
| 1323 | 2413 | 38.6 | 0 | 11.4 | 50 |
| 1360 | 2480 | 25.3 | 12.2 | 12.6 | 49.9 |
| 1388 | 2530 | 25 | 11.5 | 13.5 | 50 |
| 1393 | 2539 | 27.7 | 8.7 | 13.6 | 50 |
| 1398 | 2548 | 34.5 | 1.4 | 13.2 | 50.8 |
| 1403 | 2557 | 20.7 | 15.9 | 15.1 | 48.3 |
| 1408 | 2566 | 22.8 | 14.2 | 14.4 | 48.7 |
| 1400 | 2552 | 30 | 6.8 | 13.4 | 49.8 |
| 1401 | 2554 | 32.2 | 4 | 13.3 | 50.4 |
| 1411 | 2572 | 27.7 | 10.4 | 16 | 46 |
| 1443 | 2629 | 23.3 | 11.6 | 18.6 | 46.5 |
| 1437 | 2619 | 26.7 | 9.1 | 17.6 | 46.6 |
| 1463 | 2665 | 33.5 | 0 | 16.5 | 50 |
| 1488 | 2710 | 25 | 6.1 | 18.9 | 50 |
| 1498 | 2728 | 27.9 | 3.1 | 19.1 | 50 |
| 1510 | 2750 | 30.8 | 0 | 19.2 | 50 |
| 1533 | 2791 | 25 | 3.1 | 21.9 | 50 |
| 1852 | 3365 | 16.5 | | 83.5 | |
| 1762 | 3204 | 26.5 | | 73.5 | |
| 1604 | 2919 | 37 | | 63 | |
| 1540 | 2804 | 49 | | 51 | |
| 1371 | 2450 | 58 | | 52 | |
| 2470 | 4478 | 80 | 20 | | |
| 2370 | 4298 | 67 | 33 | | |
| 2620 | 4748 | 40 | 60 | | |
| 2730 | 4946 | 20 | 80 | | |
| 2825 | 5117 | | 100 | | |

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process of forming a calcium-magnesium-aluminosilicate penetration resistant layer, the process comprising:

providing a thermal barrier coating on a substrate to form a coating-substrate system, the thermal barrier coating comprising at least one layer of a thermal barrier coating composition; and exposing the thermal barrier coating to calcium-magnesium-aluminosilicate and gas turbine operating conditions;

wherein the exposing forms the calcium-magnesium-aluminosilicate penetration resistant layer;

wherein the thermal barrier coating composition includes a thermal conductivity which is at least about 30% less than the thermal conductivity of 7YSZ; and wherein:

all of the thermal barrier coating composition in the coating-substrate system includes, by weight, between about 50% and about 85% of the dopant incorporated in the thermal barrier composition;

all of the thermal barrier coating composition in the coating-substrate system includes, by weight, between about 30% and about 85% of a dopant incorporated in the thermal barrier composition, with the dopant being selected from the group consisting of Yb, La, Sm, Ti, Al, $InFeZnO_4$, $Yb_2O_3$, $La_2O_3$, $Sm_2O_3$, $TiO_2$, $Al_2O_3$, mischmetal oxides, and combinations thereof; or all of the thermal barrier coating composition in the coating-substrate system includes, by weight, between about 50% and about 85% of the dopant incorporated in the thermal barrier composition, with the dopant being selected from the group consisting of Yb, La, Sm, Ti, Al, $InFeZnO_4$, $Yb_2O_3$, $La_2O_3$, $Sm_2O_3$, $TiO_2$, $Al_2O_3$, mischmetal oxides, and combinations thereof.

2. The process of claim 1, further comprising forming a dense sealant reaction layer with the calcium-magnesium-aluminosilicate penetration resistant layer.

3. The process of claim 1, further comprising forming an outer face of the thermal barrier coating with the calcium-magnesium-aluminosilicate penetration resistant layer.

4. The process of claim 1, wherein the dopant is selected from the group consisting of Yb, La, Sm, Ti, Al, $InFeZnO_4$, $Yb_2O_3$, $La_2O_3$, $Sm_2O_3$, $TiO_2$, $Al_2O_3$, mischmetal oxides, and combinations thereof.

5. The process of claim 1, wherein all of the thermal barrier coating composition in the coating-substrate system includes, by weight, between about 50% and about 85% of the dopant incorporated in the thermal barrier composition.

6. The process of claim 1, wherein the calcium-magnesium-aluminosilicate penetration resistant layer includes crystallized apatite.

7. The process of claim 1, further comprising an impermeable barrier layer with the calcium-magnesium-aluminosilicate penetration resistant layer.

8. The process of claim 7, wherein the impermeable barrier layer comprises oxides selected from the group consisting of SiOxNy, $Ta_2O_5$, $HfO_2$, $TiO_2$, and combinations thereof.

9. The process of claim 7, wherein the impermeable barrier layer comprises non-oxides selected from the group consisting of carbides, nitrides, silicides, and combinations thereof.

10. The process of claim 1, further comprising forming a washable sacrificial layer with the calcium-magnesium-aluminosilicate penetration resistant layer.

11. The process of claim 10, wherein the washable sacrificial layer includes magnesia, chromia, calcia, or a combination thereof.

12. The process of claim 10, further comprising forming ash deposits from the washable sacrificial layer.

13. The process of claim 12, further comprising removing the ash deposits with a water washing step.

14. The process of claim 10, further comprising forming diopsides from MgO in the washable sacrificial layer.

15. The process of claim 14, wherein the diopside facilitates crystallization of a calcium-magnesium-aluminosilicate melt.

16. The process of claim 1, wherein the at least one layer of thermal barrier coating composition includes a plurality of layers.

17. The process of claim 16, wherein each of the plurality of layers comprises a different dopant.

18. The process of claim 1, wherein the gas turbine operating conditions include temperatures of at about 1600° C. for about 24,000 hours.

19. A process of forming a calcium-magnesium-aluminosilicate penetration resistant layer, the process comprising:

providing a thermal barrier coating on a substrate to form a coating-substrate system, the thermal barrier coating comprising at least one layer of a thermal barrier coating composition, wherein all of the thermal barrier coating composition in the coating-substrate system includes, by weight, between about 50% and about 85% of a dopant incorporated in the thermal barrier composition; and exposing the thermal barrier coating to calcium-magnesium-aluminosilicate and gas turbine operating conditions;

wherein the exposing forms the calcium-magnesium-aluminosilicate penetration resistant layer;

wherein the thermal barrier coating composition includes a thermal conductivity which is at least about 30% less than the thermal conductivity of 7YSZ; and wherein the dopant is selected from the group consisting of Yb, La, Sm, Ti, Al, $InFeZnO_4$, $Yb_2O_3$, $La_2O_3$, $Sm_2O_3$, $TiO_2$, $Al_2O_3$, mischmetal oxides, and combinations thereof.

* * * * *